US006129534A

United States Patent [19]

Schofield et al.

[11] Patent Number: 6,129,534

[45] Date of Patent: Oct. 10, 2000

[54] VACUUM PUMPS

[75] Inventors: Nigel Paul Schofield, Horsham; Michael Henry North, Reigate, both of United Kingdom

[73] Assignee: The BOC Group plc, Windlesham, United Kingdom

[21] Appl. No.: 09/334,316

[22] Filed: Jun. 16, 1999

[51] Int. Cl.[7] ..... F01C 1/24

[52] U.S. Cl. ..... 418/194; 418/3; 418/9

[58] Field of Search ..... 418/194, 3, 9

[56] References Cited

U.S. PATENT DOCUMENTS

| | | | |
|---|---|---|---|
| 3,116,871 | 1/1964 | Mishina et al. | 418/194 |
| 4,076,468 | 2/1978 | Persson et al. | 418/9 |
| 4,504,201 | 3/1985 | Wycliffe | 418/9 |
| 4,792,294 | 12/1988 | Mowli | 418/9 |
| 4,934,908 | 6/1990 | Turrell et al. | 418/9 |
| 5,549,463 | 8/1996 | Ozawa | 418/9 |
| 5,567,370 | 10/1996 | Im | 418/9 |

FOREIGN PATENT DOCUMENTS

| | | | |
|---|---|---|---|
| 0-005892 | 1/1984 | Japan | 418/9 |
| 405-231369 | 9/1993 | Japan | 418/9 |
| 384355 | 12/1932 | United Kingdom | 418/194 |

*Primary Examiner*—Thomas Denion
*Assistant Examiner*—Theresa Trieu
*Attorney, Agent, or Firm*—Salvatore P. Pace

[57] ABSTRACT

A compound vacuum pump incorporating a screw mechanism section. The screw mechanism section comprising two externally threaded rotors mounted on respective shafts in a pump body. The rotors are adapted for counter-rotation in a first chamber within the pump body with intermeshing of the rotor threads to pump gas by action of the rotors. The root diameter of each rotor increases and the thread diameter of each rotor decreases in a direction taken from pump inlet and in which the gas is pumped. The pump additionally incorporates a roots mechanism section comprising two roots-type profile rotors also mounted on the respective shafts and adapted for counter-rotation in a second chamber within the pump body situated at an inlet end of the pump.

2 Claims, 2 Drawing Sheets

VACUUM PUMPS

BACKGROUND OF THE INVENTION

The present invention relates to "hybrid" or compound vacuum pumps which have two or more sections of different operational mode for improving the operating range of pressures and throughput; and more particularly, to oil free (dry) compound vacuum pumps.

A screw pump comprising two externally threaded or vaned rotors mounted in a pump body and adapted for counter-rotation in the body with intermeshing of the rotor threads is well known. Close tolerances between the rotor threads at the points of intermeshing and with the internal surfaces of the pump body causes volumes of gas being pumped between an inlet and an outlet to be trapped between the threads of the rotors and the internal surface of the pump body and thereby urged through the pump as the rotors rotate.

Such screw pumps are potentially attractive because they can be manufactured with few working components and they have an ability to pump from a high vacuum environment at the pump inlet down to atmospheric pressure at the pump outlet.

Screw pumps are generally designed with each screw rotor being of cylindrical form overall, with the screw thread tip cross section being substantially constant along the length of the rotor. This has a disadvantage in vacuum pumps in particular that no volumetric compression is generated in use of the pump along the length of the rotor, thereby detrimentally affecting the pump's power consumption.

A further disadvantage commonly encountered with screw pumps in that they can suffer from low pumping speeds at relatively low inlet pressures, for example of the order of 50 mbar or less.

The present invention is concerned with overcoming such disadvantages and to provide a screw pump with improved power consumption coupled with improved inlet speeds.

SUMMARY OF THE INVENTION

In accordance with the invention, there is provided a compound vacuum pump incorporating a screw mechanism section and comprising two externally threaded rotors mounted on respective shafts in a pump body and adapted for counter-rotation in a first chamber within the pump body with intermeshing of the rotor threads to pump gas by action of the rotors, wherein the root diameter of each rotor increases and the thread diameter of each rotor decreases in a direction from pump inlet to pump outlet, and wherein the pump additionally includes a Roots mechanism section comprising two Roots-type profile rotors also mounted on the respective shafts and adapted for counter-rotation in a second chamber within the pump body situated at the inlet end of the pump.

The invention is based on the surprisingly synergistic effect on improved power consumption and improved inlet speeds afforded by the compound screw/Roots mode of operation coupled with the use of a tapered screw rotor profile.

Pumps of the invention provide the advantage that a volumetric compression is generated along the length of the screw mechanism (from chamber inlet to outlet) without the need to use end ports which are commonly used in air compressors. The purpose of such volumetric compression is to minimize the size of the exhaust stage of the screw section, thereby keeping the power consumption to a minimum whilst maintaining a good inlet size so as to allow faster evacuation of the chamber being pumped and faster inlet speeds of the gas being pumped. It also makes it easier for powders and other debris to be pumped without clogging the mechanism.

The presence of an integral Roots-type mechanism section in the same pump body allows for the synergistic improvements in inlet speeds.

In order for the pump to possess an increasing root diameter and a decreasing thread diameter in the screw section, the respective cavities or bores within the pump body—whose surfaces form the pump stator and which in cross sections can be represented by a "figure of eight" configuration (see later)—will taper from the inlet to the outlet.

However it is clear that a decreasing thread diameter and an increasing root diameter causes the nominally annular spaces defined between successive threads of each rotor through which the gas being pumped passes in turn during operation of the pump to decrease from pump inlet to pump outlet. As such, gas passing through the pump will increasingly be compressed.

In a preferred embodiment the screw pump rotors are both hollow and at least one bearing is located within each hollow rotor to support a respective shaft for rotational movement about its longitudinal axis.

It has been found that in some instances a screw pump section with a large Roots booster inlet stage mounted on the same shaft can not be started direct on line because at full speed with high inlet pressures the over-compression in the pump overloads the drive motor. In order to overcome this disadvantage, in a preferred embodiment use is made of an electronic drive to limit the torque delivered by a motor to one of the shafts to a level that can be sustained over a significant working period. In an alternative embodiment, a relief valve can be provided across the Roots-type pump section to limit the over-compression.

BRIEF DESCRIPTION OF THE DRAWINGS

To illustrate the invention and to show how it may be put in to effect, reference will now be made, by way of example only, to the accompanying diagrammatic drawings in which.

DETAILED DESCRIPTION

Figure 1:
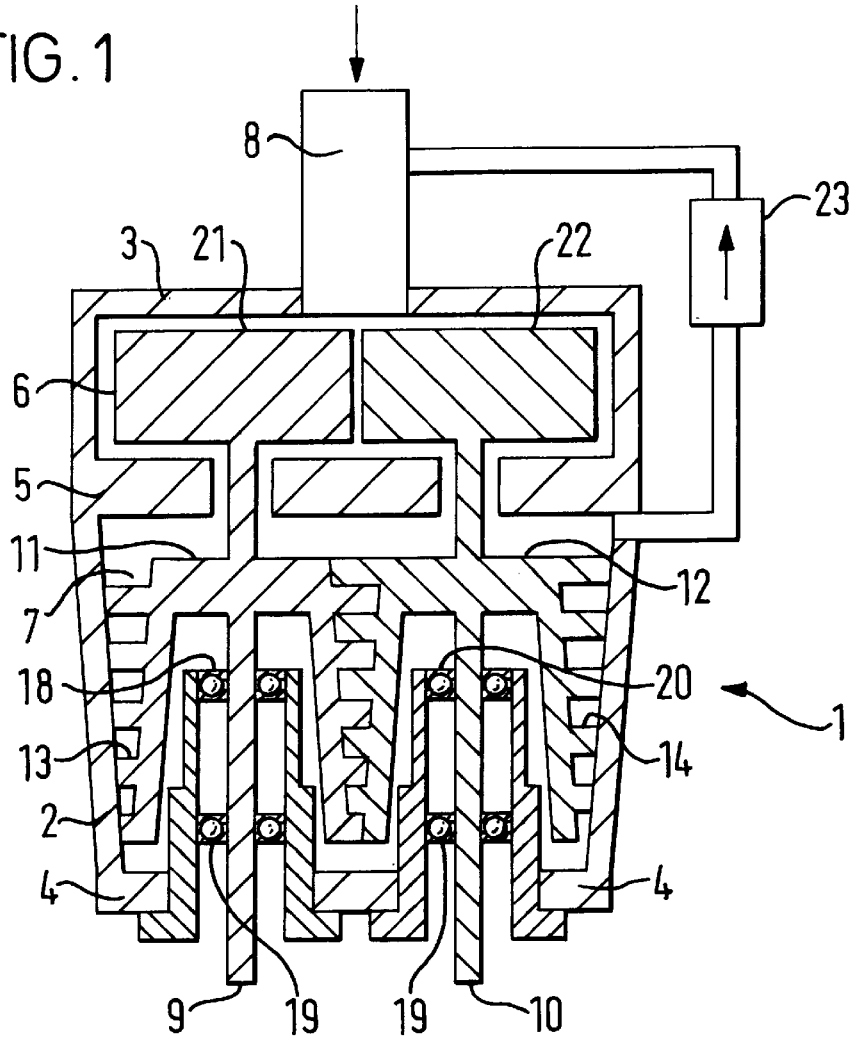
FIG. 1 is a cross-section through a compound vacuum pump according to the invention.
Figure 2:
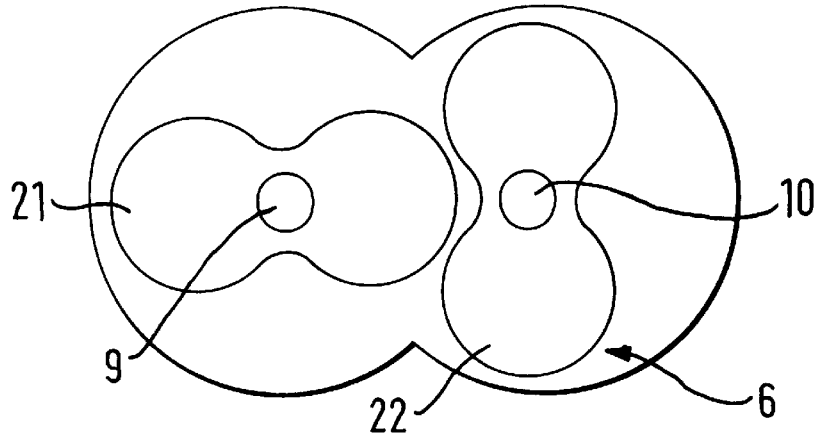
FIG. 2 is a diagrammatic side view of the Roots-type pump section of the pump of FIG. 1 along the line II—II of FIG. 1.

With reference to FIG. 1 in particular, a unitary compound vacuum pump 1 includes a pump body 2 having a top plate 3 and a bottom plate 4. Within the pump body 2 is a partition 5 which divides the interior of the pump body 1 into two parts; the upper (as shown) part accommodating a Roots-type pump section 6 and the lower (as shown) part accommodating a screw pump section 7. An inlet 8 to the pump 1 is formed in the top plate 3 and an outlet (not shown) is formed radially above the bottom plate 4. The pump body 2 defines an internal "figure of eight" shaped cavity (see FIG. 2).

The screw pump section 7 includes a first shaft 9 and spaced therefrom and parallel thereto a second shaft 10.

Mounted for rotary movement on the first shaft 9 within the pump body 2 is a rotor 11 and mounted for rotary movement on the second shaft 10 within the pump body 2 is a rotor 12. The two rotors 11, 12 are of generally cylindrical shape and on the outer surface of each rotor there is formed a continuous helical vane or thread 13, 14 respectively which vanes or threads intermesh as shown.

Figure 3:
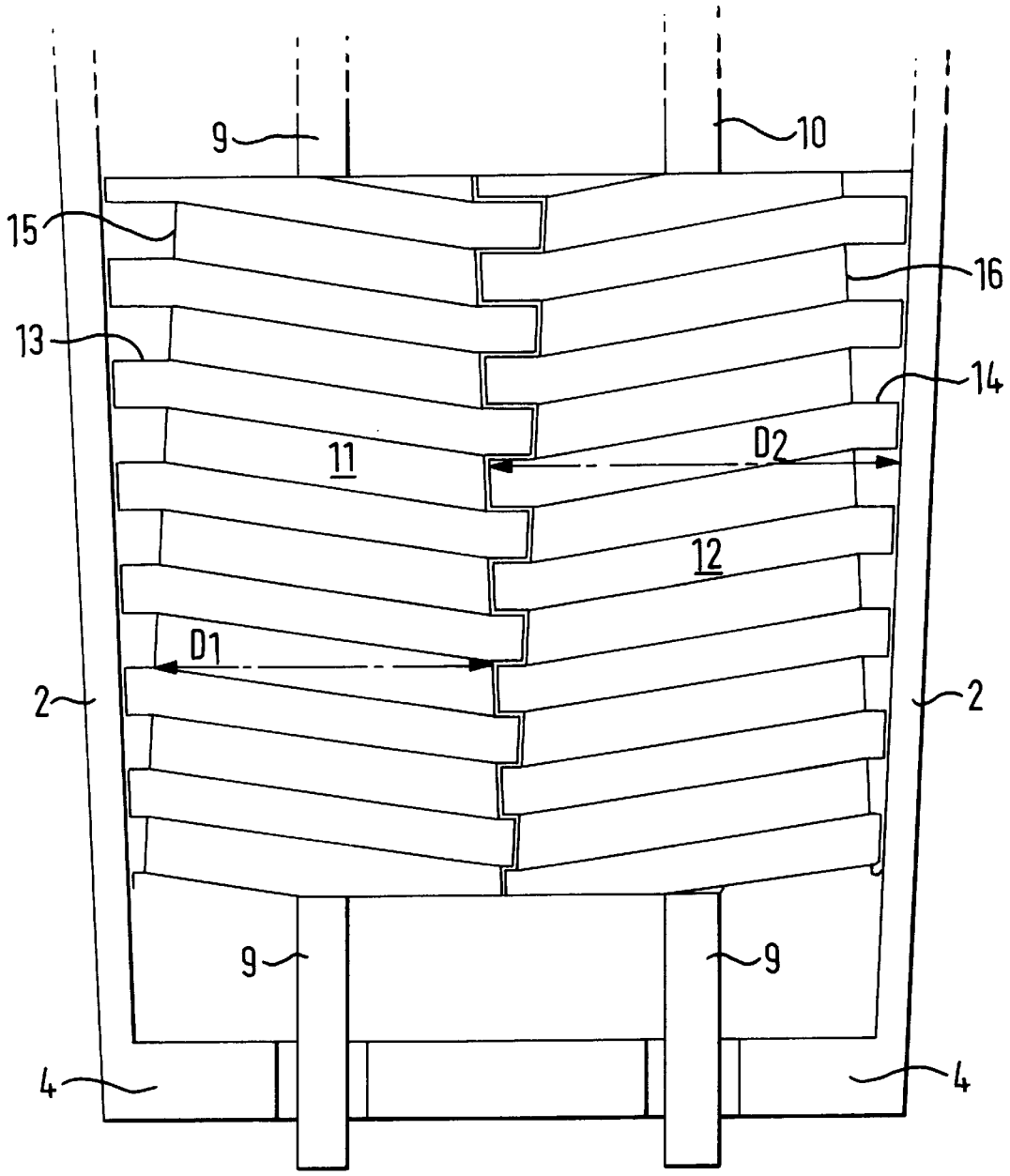
FIG. 3 is a diagrammatic view of the screw pump rotors of the pump of FIG. 1.

With particular reference to FIG. 3, each rotor 11, 12 comprises a root portion 15, 16 respectively, the root diameter $D_1$ of which increases gradually in a direction from the pump inlet to the pump outlet and the thread diameter $D_2$ of which decreases gradually again in a direction from the pump inlet to the pump outlet.

The rotors 11, 12 are hollow and each contains two spaced bearings 17, 18 and 19, 20 respectively for supporting the respective shafts 9,10.

As shown, the shafts 9, 10 extend through the partition 5 and at their upper (as shown) ends within the upper part of the pump body 2 support Roots-type profile rotors 21, 22 respectively.

The shafts 9, 10 are adapted for rotation within the pump body 2 about their longitudinal axes in contra-rotational direction by virtue of the shaft 9 being connected to a drive motor (not shown) and by the shaft 10 being coupled to the shaft 9 by means of timing gears in a manner known per se. The rotors 11, 12 and 21, 22 are positioned on their respective shafts 9,10 and located within sections 7 and 6 respectively of pump body 2 relative to the internal surfaces of the pump body 2 such that they can act in an intermeshing fashion and with close tolerances with the internal surfaces, all in a manner known per se in respect of vacuum pumps in general.

As aforesaid, in use both shafts 9 and 10 rotate at the same speed but in opposite directions. Fluid to be pumped will pass through the inlet in the top plate 3 and will be pumped by the Roots-type pump section 4 such that it passes out from that Roots-type pump section 6 through porting in the partition 5 to enter the screw pump section 2 in a general central area. The overall shape of the rotors 11, 12 and in particular the threads 13,14 relative to each other and also relative to the inside surface of the pump body 6 are calculated to ensure close tolerances with the fluid being pumped from the inlet (top as shown) towards to the bottom plate 4 and the outlet defined thereabove.

In a preferred embodiment the shaft 9 is powered by a motor which is controlled by an electronic drive and/or a relief valve is provided across the Roots-type stage in order to limit the torque delivered by the motor to the shaft 9. Such a pressure relief valve 23 is shown schematically in FIG. 1. Any excess pressure at the beginning of the screw stage of the pump will automatically trigger the opening of the valve 23 and recirculate gas being pumped back to the pump inlet 8 in the top plate 3.

A particular advantage of the embodiment described above, and generally afforded by the invention, is that the Roots-type stage 4 is fully overhung so that no bearings, and hence no lubricants, need be present adjacent the chamber being evacuated by the pump. This arrangement with the bearings 17, 18 and 19, 20 in the screw pump section 7 and removed from the chamber being pumped allows any risk of contamination of the chamber to be avoided.

We claim:

1. A compound vacuum pump comprising:

a pump body;

a screw mechanism section comprising, two externally threaded rotors mounted on respective shafts and adapted for counter-rotation in a first chamber within the pump body with intermeshing of the rotor threads to pump a gas by action of the two externally threaded rotors;

each of the two externally threaded rotors having a root diameter increasing and a thread diameter decreasing in a direction taken from pump inlet and in which the gas is pumped, and a roots mechanism section comprising two roots-type profile rotors also mounted on the respective shafts and adapted for counter-rotation in a second chamber within the pump body and situated at an inlet end of the pump.

2. The vacuum pump according to claim 1 in which each of the two externally threaded rotors is hollow contains at least one bearing to support the respective shafts for rotational movement.

* * * * *